US005095297A

United States Patent [19]

Perreault et al.

[11] Patent Number: 5,095,297

[45] Date of Patent: Mar. 10, 1992

[54] THIN FILM FUSE CONSTRUCTION

[75] Inventors: Richard J. Perreault; Jean C. Terry, both of Amesbury; Leeman G. Fitzgerald, Haverhill, all of Mass.

[73] Assignee: Gould Inc., Eastlake, Ohio

[21] Appl. No.: 700,537

[22] Filed: May 14, 1991

[51] Int. Cl.[5] ..... H01H 85/04; H01H 85/00

[52] U.S. Cl. ..... 337/297; 337/228; 337/232

[58] Field of Search ..... 337/297, 227, 228, 232, 337/231, 236, 248, 251, 252, 253, 186

[56] References Cited

U.S. PATENT DOCUMENTS

| | | | |
|---|---|---|---|
| 797,324 | 8/1905 | Sachs . | |
| 1,114,340 | 10/1914 | Cole . | |
| 1,687,247 | 10/1928 | Hickey . | |
| 1,858,245 | 5/1932 | La Mar . | |
| 2,159,423 | 5/1939 | Bussmann . | |
| 2,198,663 | 4/1940 | Floten . | |
| 2,556,018 | 6/1951 | Von Hoorn . | |
| 2,713,098 | 7/1955 | Swain . | |
| 3,041,428 | 6/1961 | Sommers . | |
| 3,253,104 | 5/1966 | Fister . | |
| 3,271,544 | 9/1966 | Ragan | 200/135 |
| 4,140,988 | 2/1979 | Oakes | 337/279 |
| 4,208,645 | 6/1980 | Harmon et al. | 337/297 |
| 4,376,927 | 3/1983 | McGalliard | 337/297 |
| 4,494,104 | 1/1985 | Holmes | 337/403 |
| 4,520,338 | 5/1985 | Watanabe | 337/297 |
| 4,570,146 | 2/1986 | Huber et al. | 337/158 |
| 4,749,980 | 6/1988 | Morrill, Jr. et al. | 337/232 |
| 4,873,506 | 10/1989 | Gurevich | 337/290 |
| 4,926,543 | 5/1990 | Morrill, Jr. et al. | 29/623 |
| 4,949,062 | 8/1990 | Mollet | 337/248 |

*Primary Examiner*—Harold Broome
*Attorney, Agent, or Firm*—Fish & Richardson

[57] ABSTRACT

A fuse including a fuse casing, an end cap terminal at an end of the casing, a substrate supporting a thin film fusible element thereon, and a disk component that is located at the end of the casing inside of the end cap terminal and has structure that defines a slot and engages an end of the substrate between opposing portions of the structure.

16 Claims, 2 Drawing Sheets

THIN FILM FUSE CONSTRUCTION

BACKGROUND OF THE INVENTION

The invention relates to fuses employing thin film fusible elements.

It is known to provide fusible elements from thin films of conductive material supported on insulating substrates. This permits an element thickness that is less than that achievable by stamping (i.e., 0.002") in order to provide low-current capacity and ease of handling during manufacture. Examples of patents describing fusible elements having thin films of conductive material on substrates provided by various deposition techniques are: U.S. Pat. Nos. 3,271,544; 4,140,988; 4,208,645; 4,376,927; 4,494,104; 4,520,338; 4,749,980; 4,873,506; and 4,926,543.

SUMMARY OF THE INVENTION

In general, the invention features a fuse made of a fuse casing, an end cap terminal at an end of the casing, a substrate supporting a thin film fusible element thereon inside the fuse casing, and a disk component that is located at the end of the casing inside of the end cap terminal and has structure that defines a slot and engages an end of the substrate. Solder makes electrical connection between the fusible element and the end cap terminal. The disk component provides good mechanical support for the substrate, locates the substrate at the desired location in the casing, and prevents the solder from wicking along the fusible element.

In preferred embodiments, the disk component has a concave portion that defines a pocket with the inner surface of the end cap terminal for containing the solder. There is a flat rim around the concave portion, and the rim contacts the fuse casing all of the way around. The fuse casing is cylindrical, and the disk component is circular. The outer diameter of the rim is larger than the inner diameter of the fuse casing, and the inner diameter of the rim is smaller than or equal to the inner diameter of the fuse casing. The slot is shorter in length than the width of the substrate, and the corners of the substrate at the end extend beyond the slot. The disk component has a flap that is bent back at the edge of the slot. There are end cap terminals at both ends of the fuse casing and disk components with slots at both ends. The length of the substrate is equal to or less than the length of the fuse casing. The fuse casing includes arc-quenching fill material. The thin film fusible element is deposited, most preferably by D.C. magnetron sputtering, although other deposition processes could also be used.

Other advantages and features of the invention will be apparent from the following description of a preferred embodiment thereof and from the claims.

DESCRIPTION OF THE PREFERRED EMBODIMENT

The preferred embodiment will now be described.

DRAWINGS

STRUCTURE, MANUFACTURE AND USE

Figure 1:
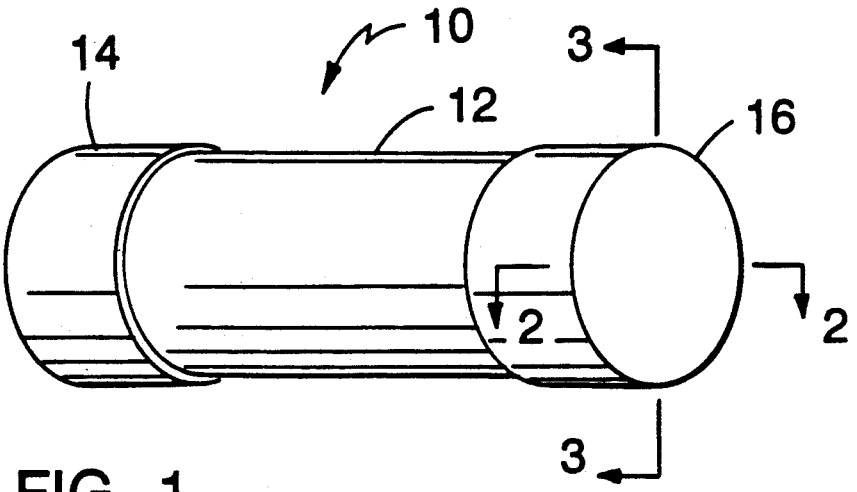
FIG. 1 is a perspective view of a fuse according to the invention.

Referring to FIG. 1, there is shown fuse 10 having cylindrical fuse casing 12 (made, e.g., of polyester, GMG, ceramic, or other fuse casing material) and metal end cap terminals 14, 16 at the ends of fuse casing 12.

Figure 2:
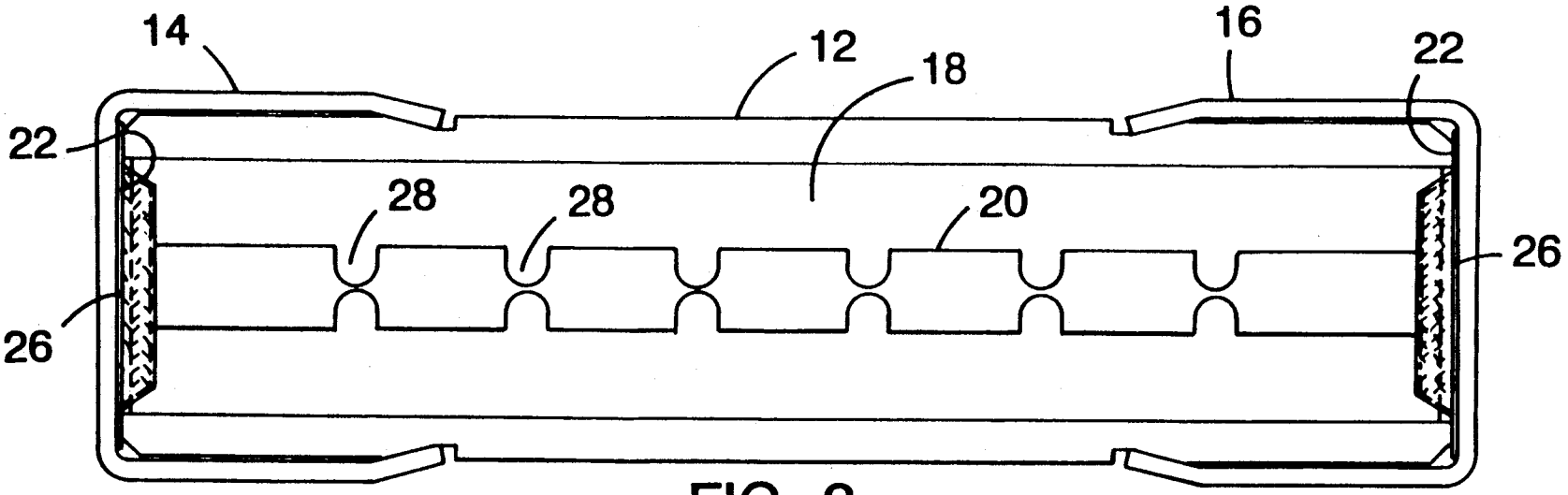
FIG. 2 is a partial, sectional view, taken at 2—2 of FIG. 1, of the FIG. 1 fuse.
Figure 3:
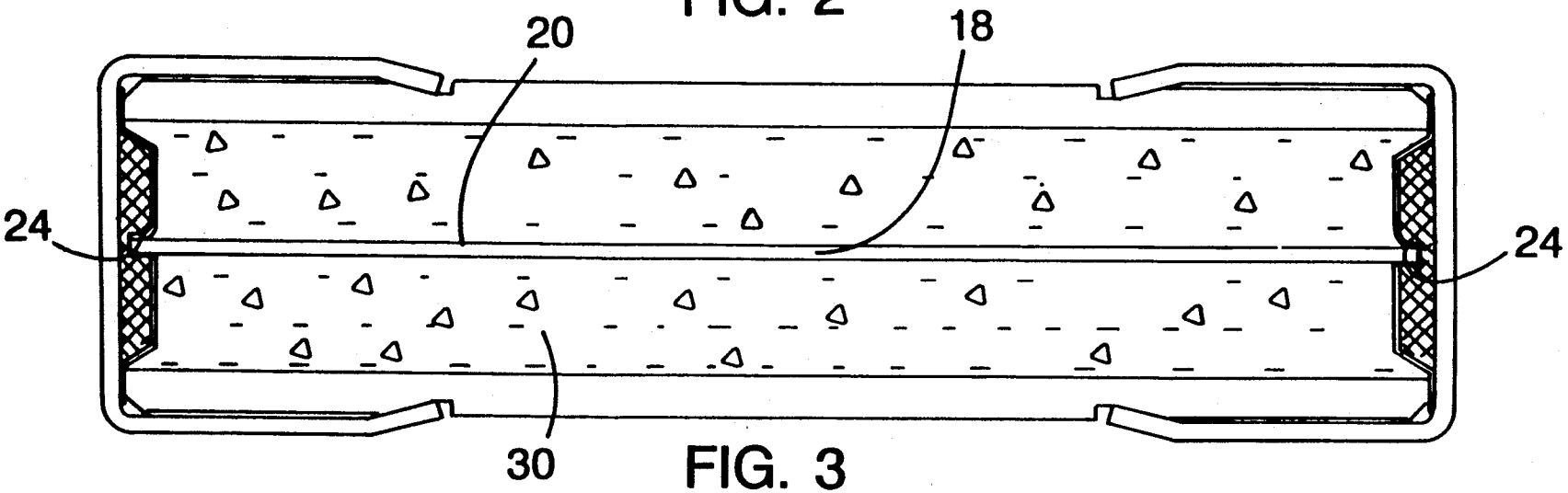
FIG. 3 is a partial, sectional view, taken at 3—3 of FIG. 1, of the FIG. 1 fuse.

Referring to FIGS. 2 and 3, it is seen that within fuse casing 12, there is rectangular ceramic substrate 18 having thin film fusible element 20 deposited thereon. Circular metal disk components 22 are located at the ends of casing 12 and inside of end cap terminals 14 and 16. Each disk component 22 has slot 24 through which an end of substrate 18 extends. Disk component 22 has an outer diameter between the inner and outer diameters of casing 12. Disk component 22 centers substrate 18 within fuse casing 12. Solder masses 26 fill up the spaces between disk components 22 and end cap terminals 14 and 16, making electrical connection between the ends of fusible element 20 and the end cap terminals 14 and 16. Fusible element 20 has a plurality of notch sections 28 along its length. Fusible element 20 is preferably deposited by D.C. magnetron sputtering and is less than 0.001" thick, the actual thickness depending upon the current rating of the fuse. E.g., copper approximately 70 microinches thick would be used for a one-amp fuse. Arc quenching fill material 30 (e.g., quartz) fills the voids within fuse casing 12.

Figure 5:
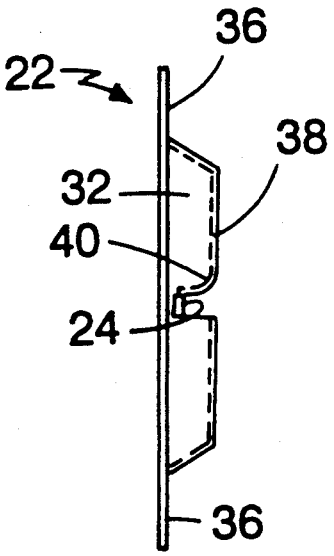
FIGS. 5 and 6 are side elevations of the FIG. 4 disk component.
Figure 4:
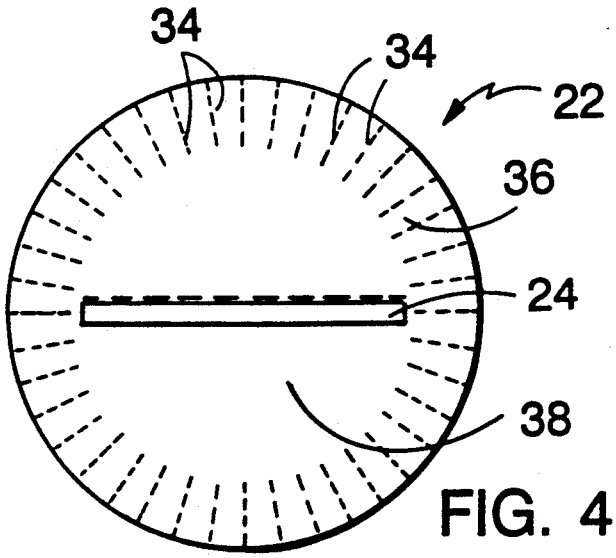
FIG. 4 is a plan view of a disk component of the FIG. 1 fuse.
Figure 6:
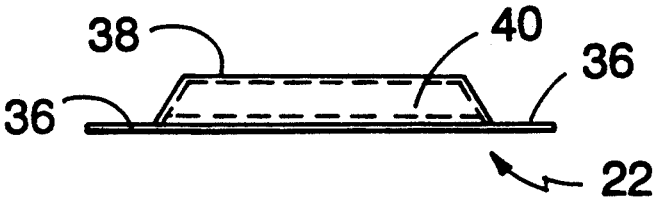

Disk component 22, referring particularly to FIGS. 4–6, is cut and stamped from a piece of copper sheet metal. Other materials that adhere to solder (e.g., brass) can also be used. The sheet metal is formed to provide concave recess 32, something which causes a slight reduction in the original outer diameter and small radial rippling 34 in generally flat outer rim 36. Central portion 38 is about 0.02" inward from the plane of rim 36. Slot 24 is provided by a three-sided cut and bending back of flap 40 between the three sides. In fuse 10, rims 36 are located between the ends of fuse casing 12 and end cap terminals 14 or 16, and concave recesses 32 provide pockets in which solder masses 26 are located. The outer diameter of rim 36 is larger than the inner diameter of fuse casing, and rim 36 contacts the end of the fuse casing 12 all the way around. The inner diameter of rim 36 is smaller than the inner diameter of fuse casing 12, and thus the concave portion fits within fuse casing 12. Slot 24 is shorter in length than the width of substrate 18, and the corners of substrate 18 at the end extend beyond slot 24, as is seen in FIG. 2. The length of substrate 18 is equal to or slightly smaller than the length of fuse casing 12. This guarantees that the ends of rigid substrate 18 will not be compressed by end cap terminals 14, 16 and damaged during manufacture and use, including use with temperature cycling and differential thermal expansion of different materials.

In manufacture, substrate 18 is placed in casing 12; a disk component 22 is added at one end of fuse casing 12, with the end of substrate 18 within slot 24; solder paste is applied to completely fill recess 32; and end cap terminal 14 is placed over disk component 22 and the end of fuse casing 12. Fuse casing 12 is then filled with arc quenching fill material 30 from the other end; a second disk component 22 is added, with the end of substrate 18 within slot 24; solder paste is applied to completely fill recess 32 of the second disk component, and end cap terminal 16 is placed over the other end of fuse casing 12. Both end cap terminals 14 and 16 are crimped, and the two ends are heated to melt and solidify the solder. Disk component 22 prevents the solder from wicking along fusible element 20, where it might destory the element or interfere with the intended operation of fusible element 20. The use of flap 40 helps create a barrier against wicking. The masses 26 of solder that result are large plugs of solder that anchor the ends of substrate 18 and make good electrical connection between the ends of fusible element 20 and end cap terminals 14 and 16. Disk components 22 and solder masses 26 together provide good mechanical support for the substrate.

OTHER EMBODIMENTS

Other embodiments of the invention are within the scope of the following claims. E.g., other techniques can be employed to create a thin film fusible element, including other vacuum deposition techniques.

What is claimed is:

1. A fuse comprising a fuse casing having an open end, an end cap terminal attached to said casing at said open end of said casing, a substrate supporting a thin film fusible element thereon and located within said casing, said substrate having an end, a disk component that is located at said open end of said casing inside of said end cap terminal and has structure that defines a slot, the end of said substrate being aligned with and extending into said slot, and a mass of solder that is between said disk component and said end cap terminal and provides electrical connection of said fusible element to said end cap terminal.

2. The fuse of claim 1 wherein said disk component has a concave portion that defines a pocket with an inner surface of said end ca terminal for containing said solder.

3. The fuse of claim 2 wherein said disk component has a flat rim around said concave portion, and said rim contacts said fuse casing all of the way around said open end.

4. The fuse of claim 1 wherein said fuse casing is cylindrical, and said disk component is circular.

5. The fuse of claim 3 wherein said fuse casing is cylindrical, and said disk component is circular.

6. The fuse casing of claim 5 wherein said rim has an outer diameter that is larger than an inner diameter of said cylindrical fuse casing, and said rim has an inner diameter that is smaller than or equal to said inner diameter of the fuse casing so that said concave portion interfits within said fuse casing and said rim abuts the end of said fuse casing.

7. The fuse of claim 1 wherein said slot is shorter in length than a width of said substrate at said end, and portions of the substrate at the end extend beyond said slot and engage portions of said disk component beyond said slot.

8. The fuse of claim 3 wherein said slot is shorter in length than a width of said substrate at said end, and portions of the substrate at the end extend beyond the slot and engage said rim.

9. The fuse of claim 1 wherein said disk component has a flap that is bent at the edge of said slot.

10. The fuse of claim 1 further comprising another end cap terminal at another end of said casing, a second disk component that is located at said another end of said casing inside of said second end cap terminal and has structure that defines a slot and engages a second end of said substrate between opposing portions of said structure, and a second mass of solder between said second disk component and said second end cap terminal and providing electrical connection of said fusible element to said end cap terminal.

11. The fuse of claim 6 further comprising another end cap terminal at another end of said casing, a second disk component that is located at said another end of said casing inside of said second end cap terminal and has structure that defines a slot and engages a second end of said substrate between opposing portions of said structure, and a second mass of solder between said second disk component and said second end cap terminal and providing electrical connection of said fusible element to said end cap terminal.

12. The fuse of claim wherein said substrate has a length which is equal to or less than a length of said fuse casing.

13. The fuse of claim 1 further comprising arc-quenching fill material in said casing.

14. The fuse of claim 1 wherein said thin film fusible element is vacuum deposited.

15. The fuse of claim 1 wherein said substrate is made of a rigid material.

16. The fuse of claim 15 wherein said substrate is made of ceramic material.

* * * * *